US011415141B1

(12) United States Patent
Wang et al.

(10) Patent No.: US 11,415,141 B1
(45) Date of Patent: Aug. 16, 2022

(54) CENTRIFUGAL COMPRESSOR HAVING POSITIVE CRANKCASE VENTILATION TUBE EXTENDING THROUGH COMPRESSOR HOUSING TO AVOID HIGH CRANKCASE PRESSURE

(71) Applicant: GM GLOBAL TECHNOLOGY OPERATIONS LLC, Detroit, MI (US)

(72) Inventors: Fengkun Wang, Rochester Hills, MI (US); Carnell E. Williams, Ortonville, MI (US); Stephanie A. Cetnar, Royal Oak, MI (US); Jordan B. Schwarz, Oxford, MI (US); Mark D. Finkel, Macomb, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 17/190,696

(22) Filed: Mar. 3, 2021

(51) Int. Cl.
*F04D 27/02* (2006.01)
*F04D 29/42* (2006.01)

(52) U.S. Cl.
CPC ..... *F04D 27/0207* (2013.01); *F04D 29/4206* (2013.01)

(58) Field of Classification Search
CPC ..... F02M 35/10222; F04D 27/0207; F04D 27/0215; F04D 27/0238; F04D 29/4206; F04D 29/4213; F05D 2220/40
See application file for complete search history.

(56) References Cited

U.S. PATENT DOCUMENTS 6,554,568 B2 * 4/2003 Fledersbacher ..... F04D 29/685 415/166
9,670,881 B2 * 6/2017 Shioda ..... F02M 26/09
10,508,627 B2 * 12/2019 Kim ..... F02M 35/10222
2008/0314351 A1 * 12/2008 Ryrholm ..... F02M 35/10222 123/184.47
2012/0297768 A1 * 11/2012 Lischer ..... F02M 26/19 60/605.2
2013/0014503 A1 * 1/2013 Romblom ..... F01D 9/026 60/605.1
2015/0136096 A1 * 5/2015 Shioda ..... F04D 29/284 123/568.14

* cited by examiner

*Primary Examiner* — Michael Lebentritt
*Assistant Examiner* — Julian B Getachew

(57) ABSTRACT

A compressor assembly includes a compressor housing and a positive crankcase ventilation (PCV) tube. The compressor housing has an inlet port configured to receive intake air at ambient pressure, an outlet port configured to discharge pressurized air, and a hollow cylindrical section having an inner radial surface and an outer radial surface. The inner radial surface of the hollow cylindrical section defines the inlet port of the compressor housing. The PCV tube is configured to allow airflow between a crankcase of an engine and the inlet port of the compressor housing. The PCV tube extends through the hollow cylindrical section of the compressor housing and beyond the inner radial surface of the hollow cylindrical section.

18 Claims, 4 Drawing Sheets

CENTRIFUGAL COMPRESSOR HAVING POSITIVE CRANKCASE VENTILATION TUBE EXTENDING THROUGH COMPRESSOR HOUSING TO AVOID HIGH CRANKCASE PRESSURE

INTRODUCTION

The information provided in this section is for the purpose of generally presenting the context of the disclosure. Work of the presently named inventors, to the extent it is described in this section, as well as aspects of the description that may not otherwise qualify as prior art at the time of filing, are neither expressly nor impliedly admitted as prior art against the present disclosure.

The present disclosure relates to centrifugal compressors having a positive crankcase ventilation tube extending through a compressor housing to avoid high crankcase pressure.

Some engine systems include a centrifugal compressor that increases the pressure of intake air delivered to an intake manifold of an engine. A centrifugal compressor typically includes an inlet, an impeller, a diffuser, and a collector. The inlet receives ambient air and is typically defined by a pipe. The impeller typically includes a rotating set of vanes (or blades) that draw air through the inlet and send the air radially outward. In a turbocharged engine, the impeller is driven by a turbine that is propelled by exhaust gas produced by the engine. In a supercharged engine, the impeller is driven by a crankshaft of the engine or by an electric motor. The diffuser reduces the velocity of air discharged by the impeller. The collector gathers air discharged by the diffuser and delivers the air to a downstream pipe. The inlet and the collector are typically formed by a compressor housing.

Positive crankcase ventilation (PCV) system delivers blow-by gases from a crankcase of an engine to a combustion chamber of the engine. Gases in a crankcase include blow-by gases that have leaked from the combustion chamber and passed through piston rings. PCV systems typically include a PCV tube, a PCV valve, and a vacuum source such as an intake manifold of an engine. The PCV tube provides a passageway for gases to flow from the crankcase to the vacuum source. In engine systems that do not include a centrifugal compressor, the PCV tube typically extends into the intake manifold of an engine. In engine systems that do include a centrifugal compressor, the PCV tube typically extends into the compressor housing. The PCV valve controls the flow of gases from the crankcase to the vacuum source. The vacuum source draws the gases from the crankcase.

SUMMARY

A compressor assembly according to the present disclosure includes a compressor housing and a positive crankcase ventilation (PCV) tube. The compressor housing has an inlet port configured to receive intake air at ambient pressure, an outlet port configured to discharge pressurized air, and a hollow cylindrical section having an inner radial surface and an outer radial surface. The inner radial surface of the hollow cylindrical section defines the inlet port of the compressor housing. The PCV tube is configured to allow airflow between a crankcase of an engine and the inlet port of the compressor housing. The PCV tube extends through the hollow cylindrical section of the compressor housing and beyond the inner radial surface of the hollow cylindrical section.

In one aspect, the PCV tube extends beyond the inner radial surface of the compressor housing by an amount that is within a range from one twenty-fifth (1/25) of a diameter of the inlet port to one-fifth (1/5) of the inlet port diameter.

In one aspect, the PCV tube extends beyond the inner radial surface of the compressor housing by an amount that is within a range from one-tenth (1/10) of a diameter of the inlet port to three-twentieth (3/20) of the inlet port diameter.

In one aspect, the PCV tube extends beyond the inner radial surface of the compressor housing by an amount that is within a range from 2 millimeters (mm) to 9 mm.

In one aspect, the PCV tube extends beyond the inner radial surface of the compressor housing by an amount that is within a range from 4 mm to 7 mm.

In one aspect, the PCV tube is formed separate from the compressor housing and joined to the compressor housing.

In one aspect, the compressor housing has a cylindrical channel that extends radially through the hollow cylindrical section of the compressor housing and receives the PCV tube, the cylindrical channel has a length that extends from the inner radial surface of the hollow cylindrical section to the outer radial surface of the hollow cylindrical section, and the cylindrical channel has a diameter that is constant along its entire length.

In one aspect, the PCV tube has a first end disposed within the inlet port of the compressor housing and a second end disposed outside of the compressor housing, and the PCV tube includes a rib that seats against the outer radial surface of the compressor housing and thereby limits an amount by which the PCV tube may be inserted into the compressor housing.

In one aspect, the compressor housing further includes a hollow toroidal section that defines a compressor collector configured to gather pressurized air flowing radially outward and to send the pressurized air toward the outlet port of the compressor housing.

In one aspect, the hollow cylindrical section has a first end that defines an entrance to the inlet port and a second end opposite of the first end, and the hollow toroidal section is joined to the hollow cylindrical section adjacent to the second end thereof.

In one aspect, the compressor housing further includes a curved tubular section having a first end and a second end opposite of the first end, the first end of the curved tubular section is joined to both the hollow cylindrical section and the hollow toroidal section, and the second end of the curved tubular section forms the outlet port of the compressor housing.

An engine system according to the present disclosure includes a crankcase, a centrifugal compressor, a positive crankcase ventilation (PCV) tube, and a PCV line. The centrifugal compressor includes a compressor housing having an inlet port configured to receive intake air at ambient pressure, an outlet port configured to discharge pressurized air, and a hollow cylindrical section having an inner radial surface and an outer radial surface. The inner radial surface of the hollow cylindrical section defines the inlet port of the compressor housing. The PCV tube extends through hollow cylindrical section of the compressor housing and beyond the inner radial surface of the hollow cylindrical section. The PCV line connects the crankcase to the PCV tube to allow airflow between the crankcase and the inlet port of the compressor housing.

In one aspect, a positive pressure layer forms near the inner radial surface of the compressor housing when operating conditions of the centrifugal compressor are near surge conditions, and the PCV tube extends beyond the inner radial surface of the compressor housing and past the positive pressure layer.

In one aspect, a reverse flow layer forms near the inner radial surface of the compressor housing when operating conditions of the centrifugal compressor are near surge conditions, and the PCV tube extends beyond the inner radial surface of the compressor housing and past the reverse flow layer.

In one aspect, the hollow cylindrical section has a first end that defines an entrance to the inlet port and second end opposite of the first end. In a central region of the inlet port, air flows in a first direction from the first end of the hollow cylindrical section to the second end of the hollow cylindrical section. In the reverse flow layer, air flows in a second direction opposite of the first direction.

In one aspect, the compressor housing further includes a hollow toroidal section that is joined to the hollow cylindrical section adjacent to the second end thereof. The hollow toroidal section defines a compressor collector configured to gather pressurized air flowing radially outward and to send the pressurized air toward the outlet port of the compressor housing.

In one aspect, the PCV tube extends beyond the inner radial surface of the compressor housing by an amount that is within a range from one twenty-fifth (1/25) of a diameter of the inlet port to one-fifth (1/5) of the inlet port diameter.

In one aspect, the PCV tube extends beyond the inner radial surface of the compressor housing by an amount that is within a range from one-tenth (1/10) of a diameter of the inlet port to three-twentieth (3/20) of the inlet port diameter.

In one aspect, the PCV tube extends beyond the inner radial surface of the compressor housing by an amount that is within a range from 2 mm to 9 mm.

In one aspect, the PCV tube extends beyond the inner radial surface of the compressor housing by an amount that is within a range from 4 mm to 7 mm.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

As discussed above, in engine systems that include a centrifugal compressor, a PCV tube typically extends into the compressor housing to enable gases to flow from a crankcase of an engine to an intake manifold of the engine. In one example, the compressor housing includes a hollow cylindrical section that forms the inlet of the compressor. The hollow cylindrical section has an inner radial surface and an outer radial surface. When the PCV tube is assembled to the compressor housing, the PCV tube extends through the outer radial surface of the compressor housing. However, the PCV tube does not extend radially inward beyond the inner radial surface of the compressor housing and into the inlet port.

The reason for preventing the PCV tube from extending into the inlet port is to avoid creating turbulence in the inlet port. However, when the compressor is operating near its surge line (i.e., when the operating conditions of the compressor are near surge conditions), a positive pressure layer may form near the inner radial surface of the compressor housing. This may lead to high crankcase pressure.

To address this issue, a compressor assembly according to the present disclosure includes a PCV tube that extends radially through the compressor housing and beyond the inner radial surface of the compressor housing. The amount by which the PCV tube extends beyond the inner radial surface of the compressor housing strikes a balance between avoiding turbulence in the inlet port and avoiding high crankcase pressure. In one example, the PCV tube extends beyond the inner radial surface of the compressor housing by an amount within a range from one twenty-fifth (1/25) of the inlet port diameter to one-fifth (1/5) of the inlet port diameter.

Figure 1:
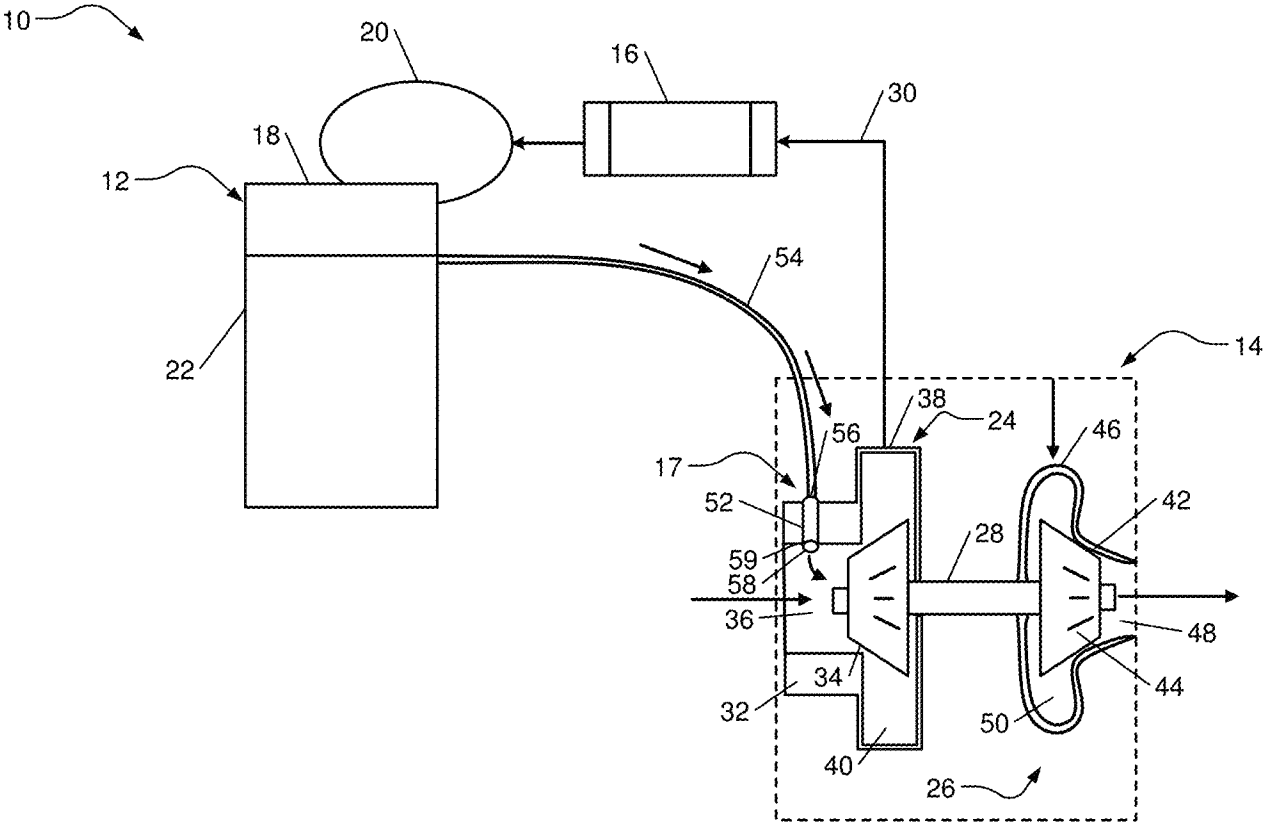
FIG. 1 is a functional block diagram of an engine system according to the present disclosure.

Referring now to FIG. 1, an engine system 10 includes an engine 12, a turbocharger 14, a charge air cooler 16, and a PCV system 17. The engine 12 includes an engine block 18, an intake manifold 20, and a crankcase 22. The engine block 18 defines one or more cylinders (not shown). The intake manifold 20 delivers intake air to the cylinders. One or more fuel injectors (not shown) inject fuel that is mixed with the intake air to form an air/fuel mixture, and the air/fuel mixture is combusted within the cylinders. Combustion of the air/fuel mixture causes pistons (not shown) to reciprocate within the cylinders, which rotates a crankshaft (not shown) and produces drive torque. The crankcase 22 houses the crankshaft.

The turbocharger 14 includes a centrifugal compressor 24, a turbine 26, and a shaft 28 connecting the compressor 24 to the turbine 26. The compressor 24 pressurizes intake air, and an intake air line 30 delivers the pressurized intake air to the intake manifold 20. The compressor 24 includes a compressor housing 32 and an impeller 34 disposed within the compressor housing 32. The compressor housing 32 defines an inlet port 36, an outlet port 38, and a compressor collector 40. As the impeller 34 rotates, the impeller 34 draws air at ambient pressure through the inlet port 36 and sends pressurized air radially outward to the collector 40. The collector 40 gathers the pressurized air flowing radially outward and sends the pressurized air to the outlet port 38, which discharges the pressurized air to the intake air line 30.

The turbine 26 drives the compressor 24 using exhaust gas produced by the engine 12. The turbine 26 includes a turbine housing 42 and an impeller 44 disposed within the turbine housing 42. The turbine housing 42 defines an inlet port 46, an outlet port 48, and a volute 50. Exhaust gas from the engine 12 enters the turbine housing 42 through the inlet port 46, flows through the volute 50 and past the impeller 44, and exits the turbine housing 42 through the outlet port 48. As the exhaust gas flows past the impeller 44, the exhaust gas causes the impeller 44 to rotate. The shaft 28 connects the impeller 34 of the compressor 24 to the impeller 44 of the turbine 26. Thus, the impeller 34 of the compressor 24 rotates with the impeller 44 of the turbine 26. Although the compressor 24 is described herein as being part of a turbocharger and driven by a turbine, the compressor 24 may instead be driven by the crankshaft of the engine 12 or by an electric motor (not shown).

The charge air cooler 16 is disposed in the intake air line 30 and cools pressurized air passing through the intake air line 30. The PCV system 17 includes a PCV tube 52 and a PCV line 54 extending from the crankcase 22 to the PCV tube 52. The PCV line 54 delivers gases from the crankcase 22 to the PCV tube 52. The PCV tube 52 has an inlet 56 that receives crankcase gases from the PCV line 54 and an outlet 58 that discharges the crankcase gases to the inlet port 36 of the compressor 24. The PCV tube 52 extends completely through the compressor housing 32 and projects radially inward from an inner radial surface 59 of the compressor housing 32 into the inlet port 36 of the compressor 24. Thus, outlet 58 of the PCV tube 52 is disposed in the inlet port 36. The PCV tube 52 projects from the inner radial surface 59 of the compressor housing 32 by an amount that ensures the outlet 58 of the PCV tube 52 is within a negative pressure layer of the inlet port 36 in all operating conditions of the compressor 24. In the example shown, the PCV tube 52 is formed separate from the compressor housing 32 and joined to the compressor housing 32. However, the PCV tube 52 may be formed (e.g., casted) with the compressor housing 32 as a single piece.

Figure 2:
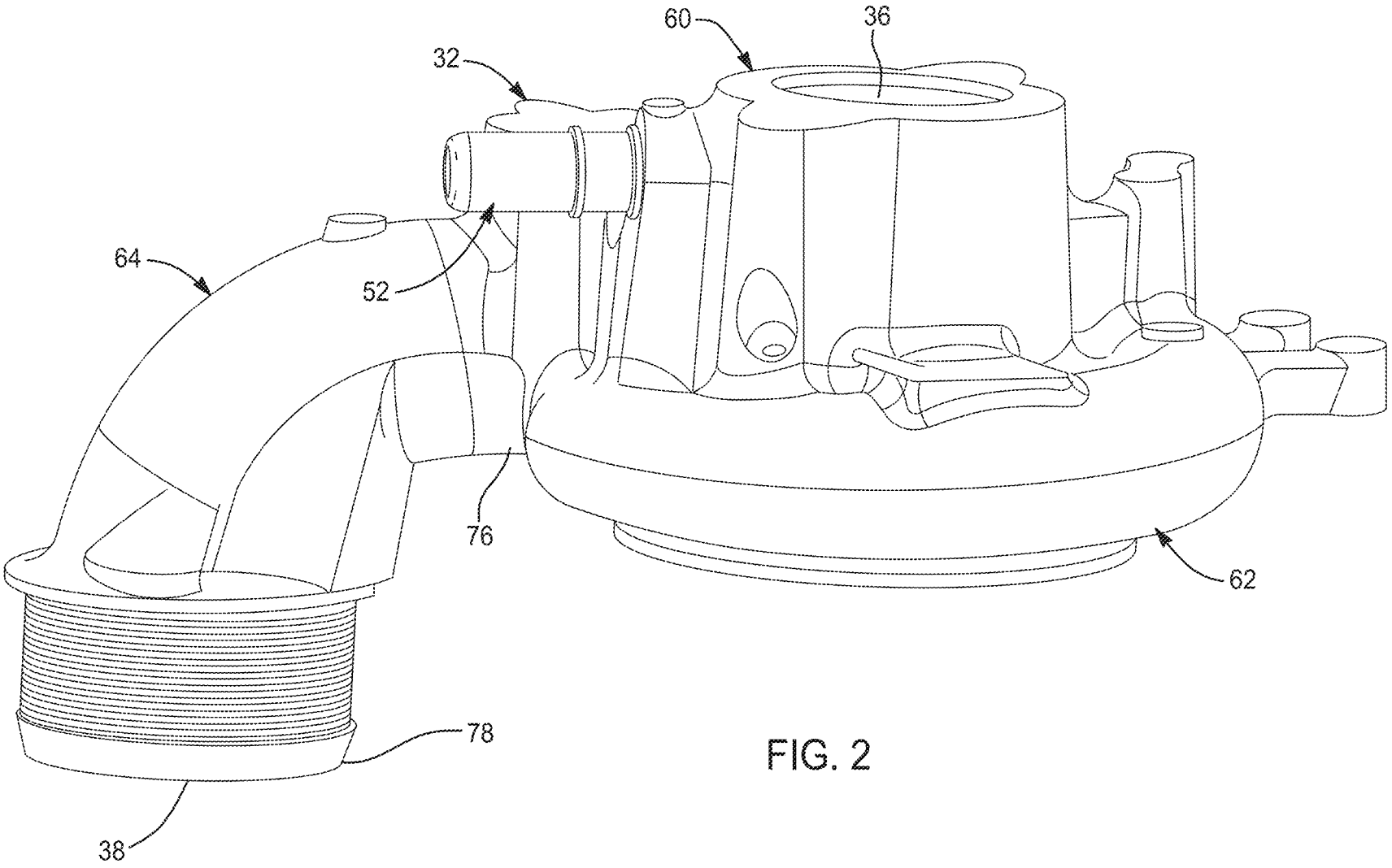
FIG. 2 is a perspective view of a compressor housing and a PCV tube according to the present disclosure.
Figure 3:
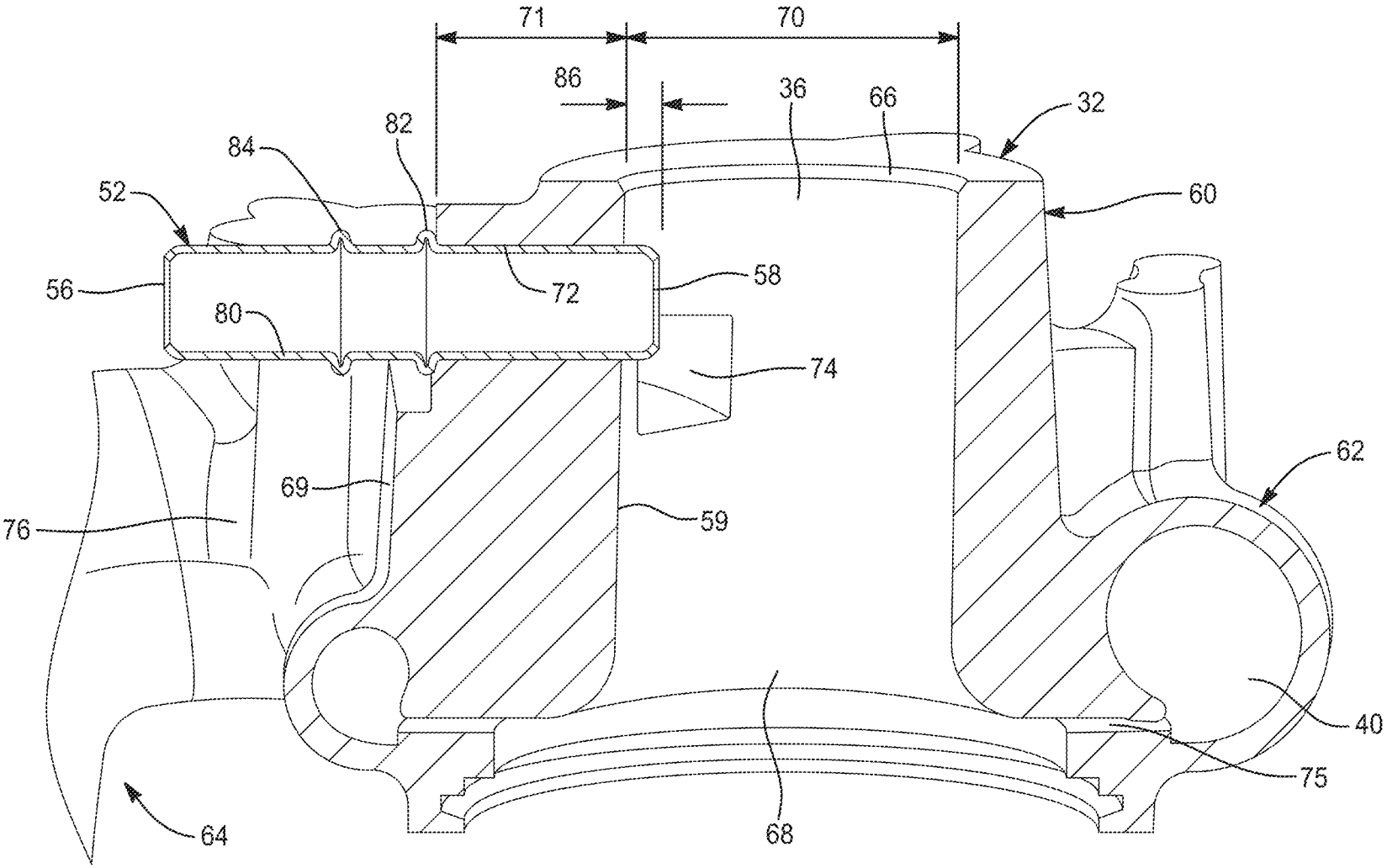
FIG. 3 is a section view of the compressor housing and the PCV tube.

Referring now to FIGS. 2 and 3, the compressor housing 32 includes a hollow cylindrical section 60, a hollow toroidal section 62, and a curved tubular section 64. The hollow cylindrical section 60 has a first end 66 that forms an entrance to the inlet port 36 and a second end 68 opposite of the first end 66. The hollow cylindrical section 60 also has the inner radial surface 59 and an outer radial surface 69. The inner radial surface 59 of the hollow cylindrical section 60 defines a diameter 70 of the inlet port 36. A distance 71 between the inner and outer radial surfaces 59, 69 is equal to the wall thickness of the hollow cylindrical section 60. In the example shown, the hollow cylindrical section 60 is tapered inward from its second end 68 to its first end 66. Thus, the wall thickness of the hollow cylindrical section 60 decreases in the direction from its second end 58 to its first end 66.

The hollow cylindrical section 60 defines a cylindrical channel 72 that extends radially therethrough and receives the PCV tube 52. The cylindrical channel 72 has a length that extends from the inner radial surface 59 of the hollow cylindrical section 60 to the outer radial surface 69 of the hollow cylindrical section 60. Thus, the length of the cylindrical channel 72 is equal to the wall thickness of the hollow cylindrical section 60 adjacent to the cylindrical channel 72. The cylindrical channel 72 has a diameter that is constant along its entire length. The diameter of the cylindrical channel 72 may be slightly larger than the diameter of the PCV tube 52. Since the cylindrical channel 72 has a constant diameter along its entire length that is slightly larger than the diameter of the PCV tube 52, the PCV tube 52 may be inserted completely through the cylindrical channel 72 with a snug fit therebetween.

In the example shown, the hollow cylindrical section 60 also defines a recirculation channel 74. The recirculation channel 74 allows pressurized air from the discharge side of the compressor 24 to the inlet port 36 thereof. Airflow through the recirculation channel 74 may be regulated by a recirculation valve (not shown). The recirculation valve may be opened to prevent the compressor 24 from surging when the inlet pressure and airflow drops rapidly while the turbocharger speed is still high, as may occur when a vehicle is accelerating and changing gears. Thus, recirculated air allows the compressor 24 to avoid the surge line on the compressor map.

The hollow toroidal section 62 is joined to the hollow cylindrical section 60 adjacent to (or at) the second end 58 thereof. The hollow toroidal section 62 defines the compressor collector 40. The collector 40 gathers pressurized air that is sent radially outward by the impeller 34 (FIG. 1), and sends the pressurized air toward the outlet port 38 of the compressor housing 32 through the curved tubular section 64. The vanes of the impeller 34 may be disposed in the inlet port 36 adjacent to the second end 68 and may extend into an annular passage 75 that allows air to flow radially outward from the inlet port 36 to the collector 40. The annular passage 75 is formed by the hollow cylindrical section 60 and/or the hollow toroidal section 62.

The curved tubular section 64 has a first end 76 and a second end 78 opposite of the first end 76. The first end 76 of the curved tubular section 64 is joined to both the hollow cylindrical section 60 and the hollow toroidal section 62. The second end 78 of the curved tubular section 64 forms the outlet port 38 of the compressor housing 32. In the example shown, the hollow cylindrical section 60, the hollow toroidal section 62, and the curved tubular section 64 are formed (e.g., cast) together as a single piece.

The PCV tube 52 includes a hollow cylindrical body 80, a first rib 82, and a second rib 84. The first and second ribs 82 and 84 project radially outward from the hollow cylindrical body 80. The first rib 82 seats against the outer radial surface 69 of the compressor housing 32 and thereby limits an amount by which the PCV tube 52 may be inserted into the compressor housing 32. Similarly, the second rib 84 may seat against the PCV line 54 and thereby limit an amount by which the PCV tube 52 may be inserted into the PCV line 54.

The PCV tube 52 extends radially inward through the hollow cylindrical section 60 of the compressor housing 32 and beyond the inner radial surface 59 of the hollow cylindrical section 60. The PCV tube 52 extends radially inward beyond the inner radial surface 59 of the hollow cylindrical section 60 by a distance 86 that strikes a balance between avoiding turbulence in the inlet port 36 and avoiding high crankcase pressure. In one example, the distance 86 is within a range from one twenty-fifth (1/25) of the diameter 70 of the inlet port 36 to one-fifth (1/5) of the inlet port diameter 70. Thus, if the inlet port diameter 70 is 45 millimeters (mm), the distance 86 may be within a range from 2 mm to 9 mm. In another example, the inlet port diameter 70 is within a range from one-tenth (1/10) of the inlet port 70 to three-twentieth (3/20) of the inlet port diameter 70. Thus, if the inlet port diameter 70 is 45 mm, the distance 86 may be within a range from 4 mm to 7 mm.

Figure 4:
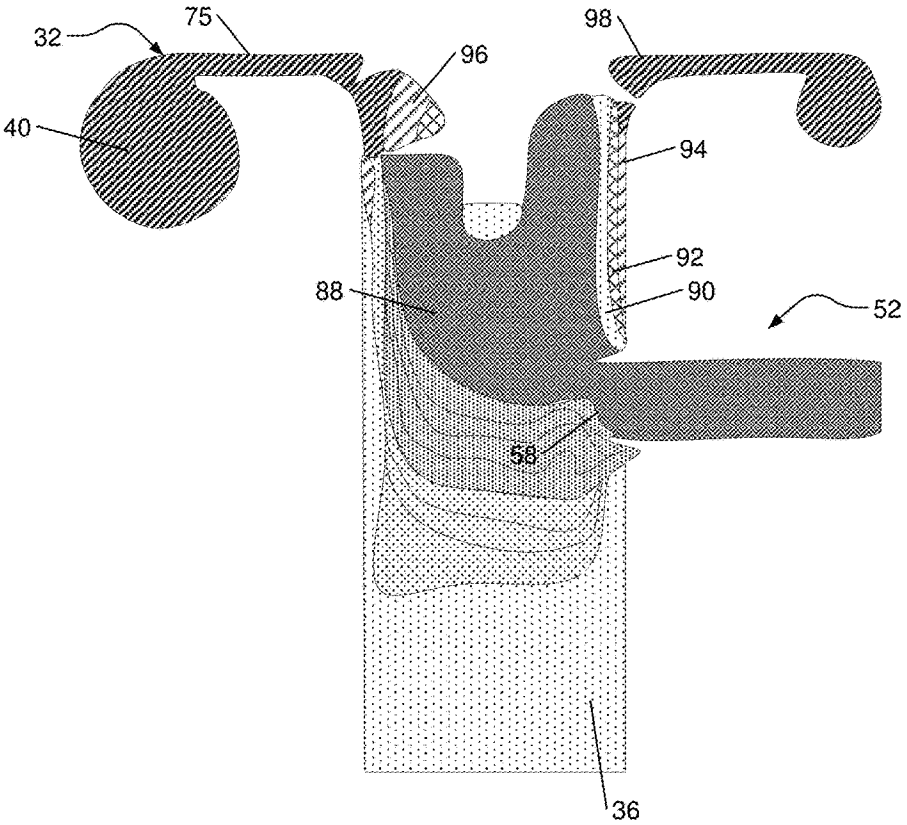
FIG. 4 is a schematic illustrating the pressure of air flowing through the compressor housing and the PCV tube.

Referring now to FIG. 4, air flowing through the compressor housing 32 and the PCV tube 52 passes through pressure layers (or zones) when the compressor 24 is operating near its surge line. The pressure layers include a pressure layer 88, a pressure layer 90, a pressure layer 92, a pressure layer 94, a pressure layer 96, and a pressure layer 98. In one example, air in the pressure layer 88 is at a pressure within a range from −5 kilopascals (kPa) to −2 kPa, air in the pressure layer 90 is at a pressure within a range from −2 kPa to 1 kPa, air in the pressure layer 92 is at a pressure within a range from 1 kPa to 4 kPa, air in the pressure layer 94 is at a pressure within a range from 4 kPa to 7 kPa, air in the pressure layer 96 is at a pressure within a range from 7 kPa to 9 kPa, and air in the pressure layer 98 is at a pressure within a range from 9 kPa to 10 kPa. Thus, a positive pressure layer (i.e., the second pressure layer 90) forms near the inner radial surface 59 of the compressor housing 32 when the compressor 24 is operating near its surge line.

The PCV tube 52 extends radially inward beyond the inner radial surface 59 of the compressor housing 32 and past the second pressure layer 90 (i.e., a positive pressure layer) to the first pressure layer 88 (i.e., a negative pressure layer). Thus, air flowing through the PCV tube 52 is at a negative pressure, and the crankcase pressure is also negative. If the PCV tube 52 did not extend radially inward past the second pressure layer 90, the pressure air flowing through the PCV tube 52 may be at a positive pressure, and the crankcase pressure may also be positive.

Figure 5:
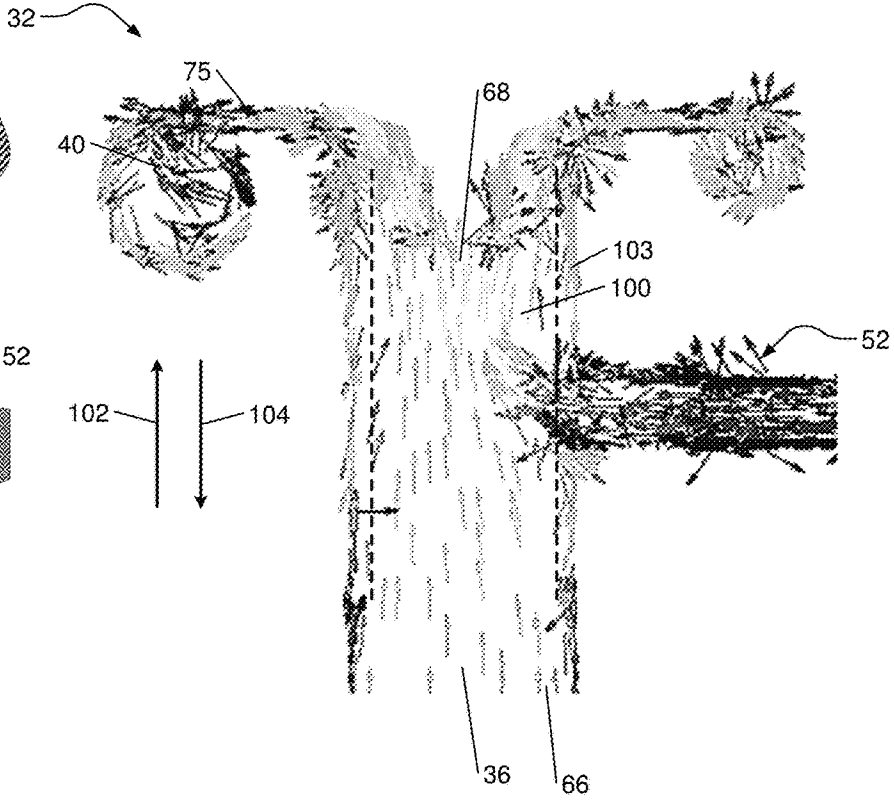
FIG. 5 is a schematic illustrating the direction in which air flows through the compressor housing and the PCV tube.

Referring now to FIG. 5, arrows indicate the direction of airflow through the compressor housing 32 and the PCV tube 52 when the compressor 24 is operating near its surge line. Air in the PCV tube 52 generally flows toward the inlet port 36 of the compressor housing 32. Air in a central region 100 of the inlet port 36 generally flows in a first direction 102 from the first end 66 of the hollow cylindrical section 60 to the second end 68 of the hollow cylindrical section 60. At the second end 68 of the compressor housing 32, air generally flows radially outward through the annular passage 75 and into the collector 40. While air in a central region 100 of the inlet port 36 generally flows in the first direction 102, air in a reverse flow layer 103 adjacent to the inner radial surface 59 of the hollow cylindrical section 60 generally flows in a second direction 104 opposite of the first direction 102. The central region 100 is the region between the dashed lines in FIG. 5. The reverse flow layer 103 is the layer disposed radially outward of the dashed lines in FIG. 5.

The reverse flow layer 103 forms when the compressor 24 is operating near its surge line. The PCV tube 52 extends radially inward beyond the inner radial surface 59 of the compressor housing 32 and past the reverse flow layer 103. Thus, air flowing through the PCV tube 52 joins air flowing through the inlet port 36 in a smooth manner. If the PCV tube 52 did not extend radially inward past the reverse flow layer 103, airflow through the PCV tube 52 may be blocked by the reverse airflow near the inner radial surface 59 of the hollow cylindrical section 60.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.).

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

As used herein, the term "and/or" includes any and all combinations of one or more of the associated listed items. As used herein, the phrase at least one of A, B, and C should be construed to mean a logical (A OR B OR C), using a non-exclusive logical OR, and should not be construed to mean "at least one of A, at least one of B, and at least one of C."

What is claimed is:

1. A compressor assembly comprising:

a compressor housing having an inlet port configured to receive intake air at ambient pressure, an outlet port configured to discharge pressurized air, and a hollow cylindrical section having an inner radial surface and an outer radial surface, the inner radial surface of the hollow cylindrical section defining the inlet port of the compressor housing; and a positive crankcase ventilation (PCV) tube configured to allow airflow between a crankcase of an engine and the inlet port of the compressor housing, the PCV tube extending through the hollow cylindrical section of the compressor housing and beyond the inner radial surface of the hollow cylindrical section, wherein the PCV tube extends beyond the inner radial surface of the hollow cylindrical section by an amount that is within a range from one twenty-fifth (1/25) of a diameter of the inlet port to one-fifth (1/5) of the inlet port diameter.

2. The compressor assembly of claim 1 wherein the PCV tube extends beyond the inner radial surface of the hollow cylindrical section by an amount that is within a range from one-tenth (1/10) of the inlet port diameter to three-twentieth (3/20) of the inlet port diameter.

3. The compressor assembly of claim 1 wherein the PCV tube is formed separate from the compressor housing and joined to the compressor housing.

4. The compressor assembly of claim 3 wherein:

the compressor housing has a cylindrical channel that extends radially through the hollow cylindrical section of the compressor housing and receives the PCV tube;

the cylindrical channel has a length that extends from the inner radial surface of the hollow cylindrical section to the outer radial surface of the hollow cylindrical section; and the cylindrical channel has a diameter that is constant along its entire length.

5. The compressor assembly of claim 3 wherein:

the PCV tube has a first end disposed within the inlet port of the compressor housing and a second end disposed outside of the compressor housing; and the PCV tube includes a rib that seats against the outer radial surface of the compressor housing and thereby limits an amount by which the PCV tube may be inserted into the compressor housing.

6. The compressor assembly of claim 1 wherein the compressor housing further includes a hollow toroidal section that defines a compressor collector configured to gather pressurized air flowing radially outward and to send the pressurized air toward the outlet port of the compressor housing.

7. The compressor assembly of claim 6 wherein:

the hollow cylindrical section has a first end that defines an entrance to the inlet port and a second end opposite of the first end; and the hollow toroidal section is joined to the hollow cylindrical section adjacent to the second end thereof.

8. The compressor assembly of claim 6 wherein:

the compressor housing further includes a curved tubular section having a first end and a second end opposite of the first end;

the first end of the curved tubular section is joined to both the hollow cylindrical section and the hollow toroidal section; and the second end of the curved tubular section forms the outlet port of the compressor housing.

9. A compressor assembly comprising:

a compressor housing having an inlet port configured to receive intake air at ambient pressure, an outlet port configured to discharge pressurized air, and a hollow cylindrical section having an inner radial surface and an outer radial surface, the inner radial surface of the hollow cylindrical section defining the inlet port of the compressor housing; and a positive crankcase ventilation (PCV) tube configured to allow airflow between a crankcase of an engine and the inlet port of the compressor housing, the PCV tube extending through the hollow cylindrical section of the compressor housing and beyond the inner radial surface of the hollow cylindrical section, wherein the PCV tube extends beyond the inner radial surface of the hollow cylindrical section by an amount that is within a range from 2 millimeters (mm) to 9 mm.

10. The compressor assembly of claim 9 wherein the PCV tube extends beyond the inner radial surface of the hollow cylindrical section by an amount that is within a range from 4 mm to 7 mm.

11. An engine system comprising:

a crankcase;

a centrifugal compressor including a compressor housing having an inlet port configured to receive intake air at ambient pressure, an outlet port configured to discharge pressurized air, and a hollow cylindrical section having an inner radial surface and an outer radial surface, the inner radial surface of the hollow cylindrical section defining the inlet port of the compressor housing;

a positive crankcase ventilation (PCV) tube extending through hollow cylindrical section of the compressor housing and beyond the inner radial surface of the hollow cylindrical section; and a PCV line connecting the crankcase to the PCV tube to allow airflow between the crankcase and the inlet port of the compressor housing, wherein:

a positive pressure layer forms near the inner radial surface of the hollow cylindrical section when operating conditions of the centrifugal compressor are near surge conditions; and the PCV tube extends beyond the inner radial surface of the hollow cylindrical section and past the positive pressure layer.

12. The engine system of claim 11 wherein:

a reverse flow layer forms near the inner radial surface of the hollow cylindrical section when the operating conditions of the centrifugal compressor are near the surge conditions; and the PCV tube extends beyond the inner radial surface of the hollow cylindrical section and past the reverse flow layer.

13. The engine system of claim 12 wherein:

the hollow cylindrical section has a first end that defines an entrance to the inlet port and second end opposite of the first end;

in a central region of the inlet port, air flows in a first direction from the first end of the hollow cylindrical section to the second end of the hollow cylindrical section; and in the reverse flow layer, air flows in a second direction opposite of the first direction.

14. The engine system of claim 13 wherein the compressor housing further includes a hollow toroidal section that is joined to the hollow cylindrical section adjacent to the second end thereof, the hollow toroidal section defining a compressor collector configured to gather pressurized air flowing radially outward and to send the pressurized air toward the outlet port of the compressor housing.

15. The engine system of claim 11 wherein the PCV tube extends beyond the inner radial surface of the hollow cylindrical section by an amount that is within a range from one twenty-fifth (1/25) of a diameter of the inlet port to one-fifth (1/5) of the inlet port diameter.

16. The engine system of claim 11 wherein the PCV tube extends beyond the inner radial surface of the hollow cylindrical section by an amount that is within a range from one-tenth (1/10) of a diameter of the inlet port to three-twentieth (3/20) of the inlet port diameter.

17. The engine system of claim 11 wherein the PCV tube extends beyond the inner radial surface of the hollow cylindrical section by an amount that is within a range from 2 mm to 9 mm.

18. The engine system of claim 11 wherein the PCV tube extends beyond the inner radial surface of the hollow cylindrical section by an amount that is within a range from 4 mm to 7 mm.

* * * * *